United States Patent [19]

Rowland

[11] Patent Number: 4,968,973

[45] Date of Patent: Nov. 6, 1990

[54] ANTI-THEFT DEVICE

[75] Inventor: Barry F. Rowland, Vancouver, Canada

[73] Assignee: Prometheus Product Development Corp., Vancouver, Canada

[21] Appl. No.: 421,868

[22] Filed: Oct. 16, 1989

[51] Int. Cl.[5] ..... G08B 13/14

[52] U.S. Cl. ..... 340/571; 340/427; 340/693

[58] Field of Search ..... 340/571, 572, 573, 568, 340/427, 540, 686, 693

[56] References Cited

U.S. PATENT DOCUMENTS

| | | | |
|---|---|---|---|
| 4,313,521 | 2/1982 | Rodden | 181/160 |
| 4,322,714 | 3/1982 | Morgan | 340/568 |
| 4,385,288 | 5/1983 | Bitko | 340/571 |
| 4,602,245 | 7/1986 | Yawg et al. | 340/384 R |
| 4,772,879 | 9/1988 | Hein | 340/571 |
| 4,837,835 | 6/1989 | Murayama | 340/568 |

*Primary Examiner*—Joseph A. Orsino
*Assistant Examiner*—Geoff Sutcliffe
*Attorney, Agent, or Firm*—Townsend and Townsend

[57] ABSTRACT

An anti-theft device for attachment to an object has an alarm generator for emitting an audible alarm in response to an alarm signal and a motion sensor for initiating the alarm signal in response to movement of the anti-theft device. A retaining member engages the object to secure the anti-theft device to the object and a device responsive to movement of the retaining member initiates an alarm signal in the case of tampering.

12 Claims, 4 Drawing Sheets

ANTI-THEFT DEVICE

FIELD OF THE INVENTION

The present invention relates to anti-theft devices for attachment to objects, for example for attachment to bicycles, skiing equipment, golfing equipment, and other portable sports and other equipment.

More particularly, the present invention relates to an anti-theft device of the type comprising a motion sensor, which can be activated to initiate the generation and emission of an audible alarm signal in response to movement of the object to which the anti-theft device is attached.

BRIEF SUMMARY OF THE INVENTION

It is an object of the present invention to provide an anti-theft device of the type employing a motion sensor with means for providing a warning of tampering of the device by an unauthorized person seeking to remove the device from an object to which it is attached.

According to the present invention, there is provided an anti-theft device for attachment to an object, comprising an alarm generator means for emitting an audible alarm in response to an alarm signal and motion sensor means for initiating the alarm signal in response to movement of the anti-theft device. Retaining means for engaging the object to secure the anti-theft device to the object are provided with means responsive to tampering with the retaining means for initiating a tamper signal. The alarm generator means includes means for generating an alarm in response to the tamper signal.

Battery securing means releasably engageable by the retaining means secure batteries within the anti-theft device in a storage position in which the batteries are inaccessible from the exterior of the anti-theft device. The battery securing means are releasable, by disengagement of the retaining means from the battery securing means, to permit removal of the batteries from the anti-theft device.

In the preferred embodiment of the invention, the retaining means include a threaded shaft for releaseably securing the anti-theft device to its object, the shaft being releasable by unscrewing rotation of the shaft to enable removal of the anti-theft device from the object, and the tampering responsive means comprising means responsive to unscrewing rotation of the threaded shaft.

BRIEF DESCRIPTION OF THE DRAWINGS

Further objects, features and advantages of the present invention will appear from the following description thereof when taken in conjunction with the accompanying drawings, in which.

DESCRIPTION OF THE PREFERRED EMBODIMENTS

Figure 1:
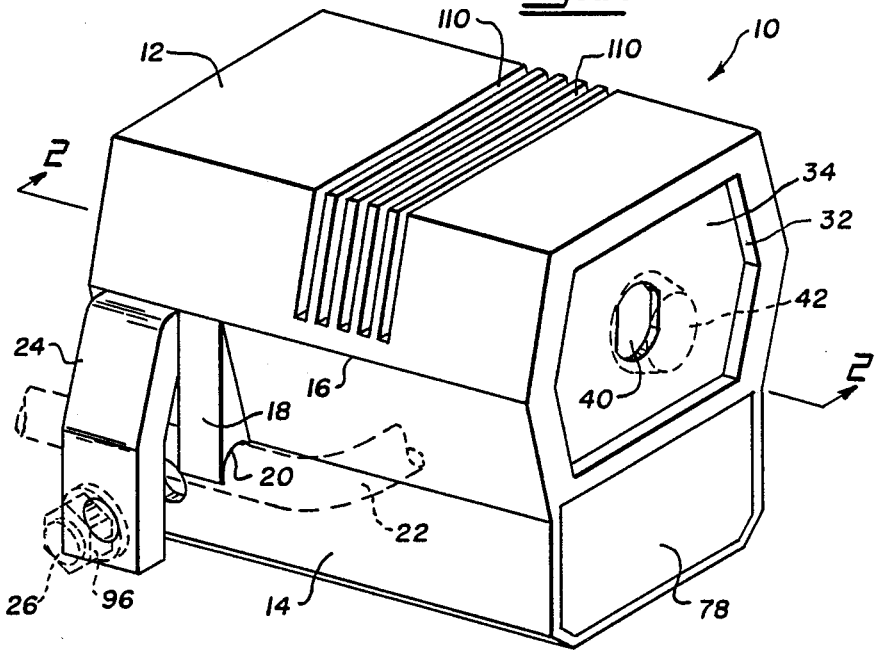
FIG. 1 shows a view in perspective of a bicycle anti-theft device incorporating a motion sensor according to the present invention.

Referring now to the accompanying drawings and, in particular, to FIG. 1, reference numeral 10 indicates generally an anti-theft device for use on a bicycle.

The anti-theft device 10 comprises a housing formed by an upper housing portion 12 and a lower housing portion 14, which are made of plastics material and which are welded to one another along a joint line 16.

The lower housing portion 14 has, at each side thereof, a first projection 18 which projects laterally from the housing 10 and which is formed with a cylindrically concave underside 20, which is shaped to seat snugly on a respective one of a pair of cylindrical seat rails 22.

The lower housing portion 14 is also formed, adjacent the first projections 18, with a pair of second projections in the form of laterally outwardly and downwardly depending arms 24, through which extends a bolt 26 which secures the entire anti-theft device 10 to the seat rails 22 in a tamper-proof manner, as described in greater detail below. For the present, it is simply pointed out that the bolt 26 extends beneath the seat rails 22.

The housing upper portion 12 has a rear wall 28 formed in one piece therewith, which is connected along the weld join line 16 to a rear wall 30 intregal with the lower housing portion 14.

In this way, the rear end of the interior of the housing is closed by the walls 28 and 30.

The front ends of the upper housing portion 12 and the lower housing portion 14 form a front opening 32, which is closed by a hexagonal closure plate 34, the periphery of which is received in recesses 36 and 38 formed in the upper and lower housing portions 12 and 14.

The closure plate 34 is formed with a circular opening 40, through which extends a lock 42.

Within the interior of the housing, the lock 42 is connected to a hub portion 44 forming part of a component mechanism which has a solid annular rim 46 extending around and spaced from the hub portion 44, and a pair of helically-shaped, radially outwardly extending flanges 48, which slidably engage in correspondingly helically-shaped internal recesses 50 formed in the inner sides of the housing portions 12 and 14.

The arrangement is such that, upon insertion of a key (not shown) into the lock 42, and rotation of the key, the hub portion 44 and, therewith, the rim portion 46 and the helical flanges 48 are rotated, so that by the interengagement of the helical flanges 48 and the helical recess 50, the rim portion 46 and the hub portion 44 are displaced axially, along an axis A.

The hub portion 44 carries a disc member 52, the outer periphery of which is engaged in the rim portion 46.

This disc member 52 is a printed circuit board, on which an endless array of electrical contacts is printed, as described in greater detail below.

Four radially spaced prongs 54, projecting longitudinally from the inner end of the hub portion 44 and formed at their free ends with retaining shoulders 56, serve to retain cylindrical members 58 and 60 on the hub portion 44 and the fingers 54.

The fingers 54 with their cylindrical members 58 and 60 project into a conical member 62. An annular peripheral flange 64 on the conical member 62 engages in a corresponding annular recess 66 formed on the interiors of the upper and lower housing portions 12 and 14 for retaining the conical member 62 in position with the axis of the conical member coincident with the axis A.

The conical member 62 has an internal surface 68, a frusto-conical surface portion of which, together with an annular surface portion 70 of the disc member 52, forms a ball race for an electrically conductive ball 72.

Figure 3:
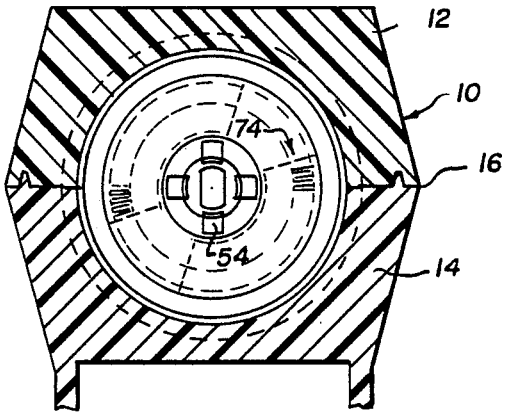
FIG. 3 shows a view in transverse section through the device taken along the line 3—3 of FIG. 2.
Figure 4:
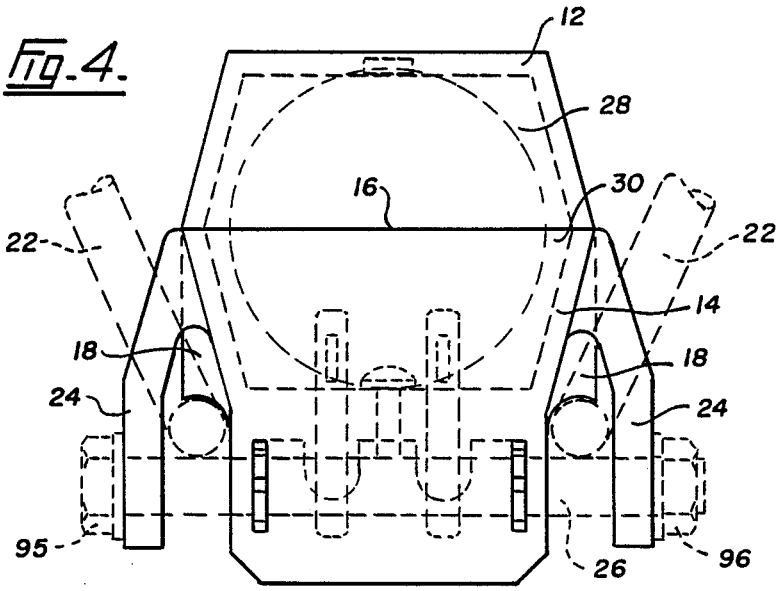
FIG. 4 shows a view in end elevation of the device of FIGS. 1 through 3.

An electrical conductor array 74 (FIG. 3) is formed around a peripheral portion of the annular surface 70, and the conical member 62 is made of electrically conductive material so that, when the device is in an operative condition, as described below, the ball 72 forms an electrically conductive bridge between the contact array 74 and the conical member 62.

Figure 2:
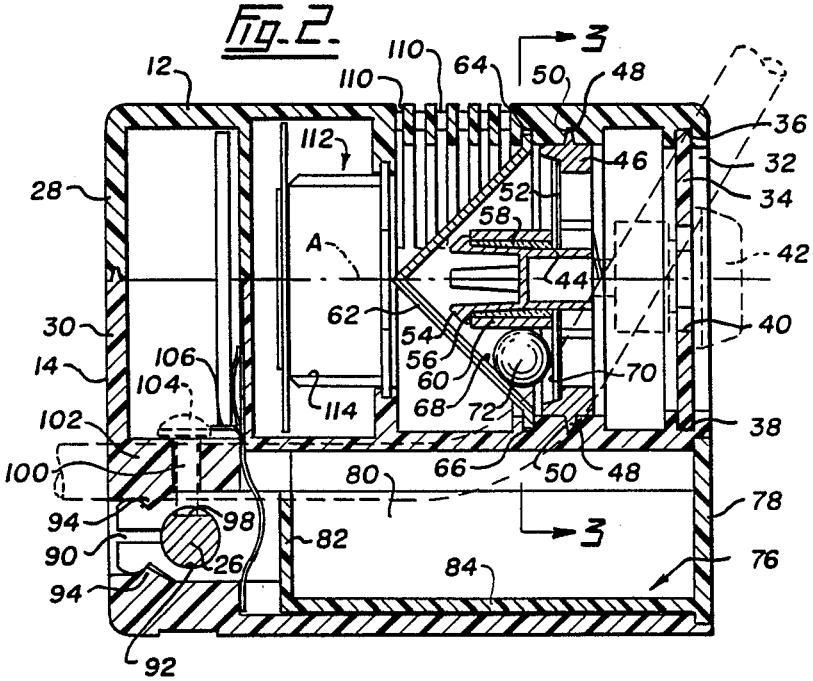
FIG. 2 shows a view in longitudinal cross-section through the device of FIG. 1, taken along the line 2—2 of FIG. 1.

In the condition shown in FIG. 2, the device is in an inoperative position, in which the disc member 52 has been displaced towards the conical member 62, by actuation of the lock 42, along the axis A. The ball 72 is thus displaced radially inwardly relative to the axis A, into an inoperative position in which the ball 72, at the point of which it makes contact with the annular member 52, is displaced radially inwardly from the contact array 74.

In this inoperative position of the ball 72, the ball 72 is urged against the outer cylinder core member 60 on the hub portion 44 and the fingers 54. This cylindrical portion 60 is made of resilient material, so that the ball is resiliently but securely held in the position in which it is shown in FIG. 2.

When, however, by actuation of the lock 42 by its key, and by consequential rotation of the helical flanges 48 in their recesses 50 and, thus, the displacement of the hub portion 44 and, therewith, the disc member 52 to the right, as viewed in FIG. 2, along the axis A, the ball 72 can roll downwardly from the position in which it is shown in FIG. 2 towards the peripheries of the conical member 62 and the disc member 52, until it makes electrical contact with the contact array 74. The anti-theft device 10 is then in an operative condition, and acts as an alarm device, in response to motion, as described in greater detail below.

Figure 5:
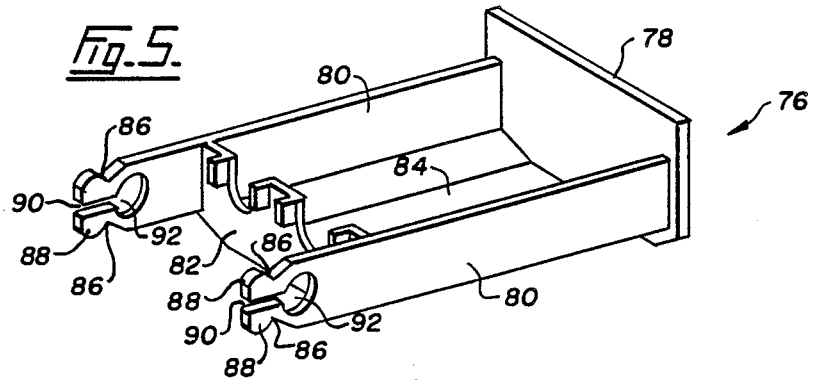
FIG. 5 shows a view in perspective of a battery tray forming part of the device of FIGS. 1 through 4.

The lower housing portion 14 contains a tray, which is indicated generally by reference numeral 76 in FIG. 5, and which is formed with a front wall 78, a pair of side walls 80, a rear wall 82 and a bottom 84.

The rear ends of the rear walls 80 are formed, at the top and bottom thereof, with notches 86 and end portions 88 of the reduced height, the end portions 88 of each wall 80 being separated by a horizontally extending slot 90 extending into a circular opening 92.

With this arrangement, when the tray is slid rearwardly into the lower housing portion 14, the end portions 88 of each wall 80 are pushed between a pair of mutually opposed projections 94 formed on the interior of the lower housing portion 14 at the rear thereof. In this way, the two end portions 88 of each wall 80 are pressed together resiliently as they pass between the projections 94, these end portions 88 then springing apart from one another so that the projections 94 are engaged in the notches 86, as shown in FIG. 2.

The bolt 26 is then inserted through the arms 24 and, thereby through the circular openings 92 in the walls 80 so as to retain the battery tray 76 in the lower housing portion 14, the bolt 26 being retained by a head 95 at one end and a nut 96 at the other end.

The bolt 26 is formed, at its midpoint, with at least one flat 98, onto which drops the lower end of an actuating pin 100, the bolt 26 being rotated into an appropriate position, in which it is shown in FIG. 2, for this purpose.

The actuating pin 100 is vertically slidably received in an intregal, inwardly projecting ledge 102 forming part of the lower housing portion 14 and extending inwardly thereof from the rear wall 30.

The actuating pin 100 has a head 104, which engages a contact member 106.

The purpose of the actuating member 100 and its contact member 106 is to initiate operation of an alarm circuit, described below, in the event that an unauthorized person attempts to tamper with the anti-theft device 10 by rotating the bolt 26 in order to release the anti-theft device 10 from its bicycle.

As can be seen from FIGS. 1 and 2, the upper housing portion 12 is formed with a plurality of parallel slots 110, through which the interior of the housing communicates with the exterior atmosphere.

Referring to FIG. 2, it will be seen that these slots 110 are located radially outwardly of the conical member 62.

The housing also contains an electro-acoustic transducer indicated generally by reference numeral 112 and having a cavity 114 facing towards the conical member 62 which is coaxial with and tapers towards the transducer 112. The transducer cavity 114 forms a Helmholz resonator for the sound vibrations produced by the transducer 112. The resultant sound, serving as an alarm signal, is deflected outwardly through the slots 110 by the conical member 62 and thereby broadcast.

Figure 6:
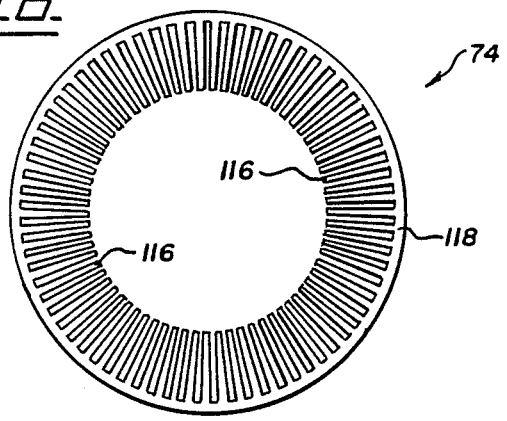
FIG. 6 shows one form of electrical contact array for use in the device of FIGS. 1 through 4.

FIG. 6 shows a diagrammatic illustration of the annular contact array 74. As can be seen from FIG. 6, this array comprises a plurality of radially extending. equiangularly spaced contact strips 116 connected by a common annular conductor 118.

With such an array, as the ball 72 rolls around the array, in response to motion of the anti-theft device 10, the ball successively makes contact with the contact strips 116 and with the areas of the electrically-insulating board forming the disc member 52.

Since the ball 72 is also simultaneously rolling on the electrically conductive conical member 62, the ball, during its rolling motion around the annular array, successively and repeatedly makes and breaks an electrical connection between the annular contact strip array 74 and the electrically conductive conical member 62. Corresponding electrical pulses produced in this way are used to initiate the emission of the audible alarm signal by the transducer 112, as described in greater detail below.

Figure 7:
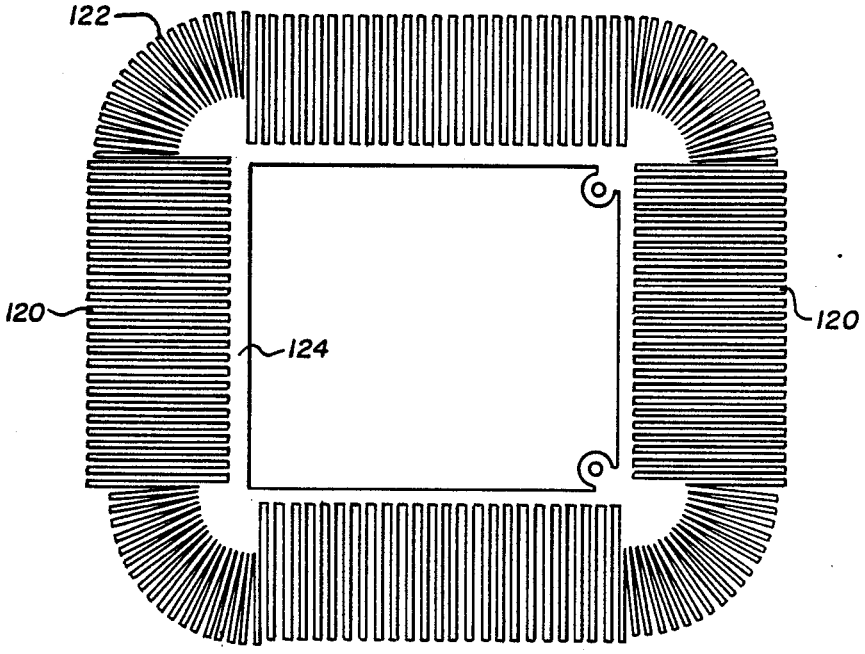
FIG. 7 shows another form of contact array for use in the device of FIGS. 1 through 4.

FIG. 7 shows a modified form of conductor strip array in which, instead of comprising an annular array of conductor strips as shown in FIG. 6, is composed instead of a generally square array of conductor strips 120 and 122, the conductor strips 122 being provided at the four corners of the array and the conductor strips 120 being provided between the corners of the array. A common, square conductor strip 124 interconnects the conductor strips 120 and 122. In this case, the conical member 62 is replaced by hollow, convergent member of generally square cross-section, with rounded corners, corresponding to the conductor array.

With this modified conductor array arrangement, the device exhibits a greater sensitivity to motion when the ball is located between these corners of the array than when the ball is at one of the corners. This arrangement may be utilized, for example, to provide greater sensitivity of the motion conductor when the bicycle is in the normal position in which it is left unattended, e.g. in an upright condition.

The conductor array may have a shape other than the annular and square shapes referred to above, e.g. a triangular array or a non-symmetrical shape. In each case other than the annular shape, the radius of curvature of the rolling path of the ball 72 varies, around the path, in accordance with the shape of the conductor array, and the angle between the conductor strip correspondingly varies. Thus, the sensitivity of the device to movement is correspondingly varied around the path.

The sensitivity may also be varied around the path by varying the lateral spacings of the conductor strips.

In addition, it has been found that the height or thickness of the conductor strips, in a direction perpendicular to the board on which they are provided, affects the hysteresis of the initial ball motion in response to motion of the sensor device. Thus, the greater the strip thickness is, then the greater is the ball motion hysteresis.

Figure 8:
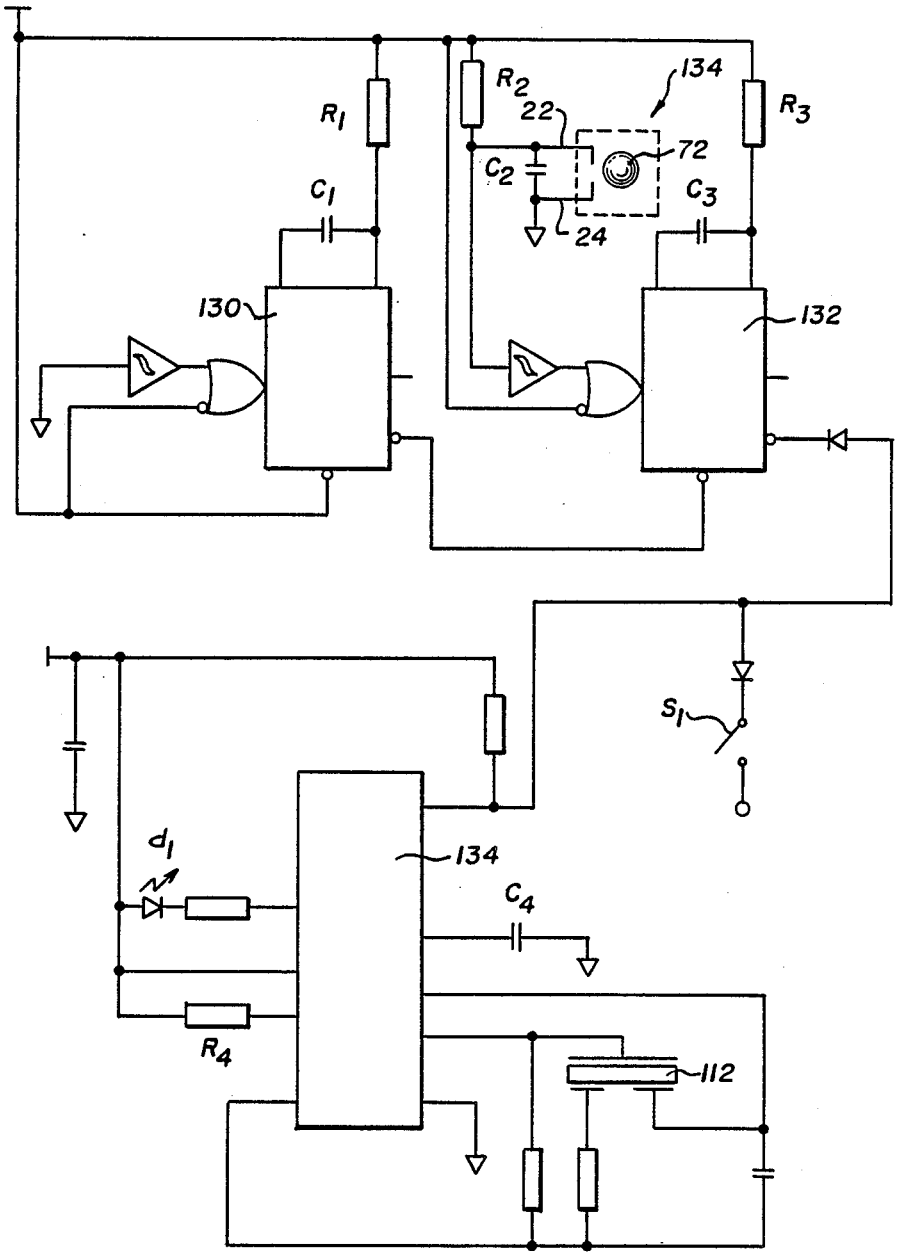
FIG. 8 shows the electrical circuit diagram of the device of FIGS. 1 through 4.

As shown in FIG. 8, the electronic circuit for controlling the above-described anti-theft device comprises a first monostable 130, implemented by a 4538B integrated circuit device which serves to provide a delay time when power is first applied to the circuit in order to allow the motion sensor to stabilize. Thus, motion of the bicycle for this period of time, following the activation of the anti-theft device by the user, resulting e.g. from adjustments to the position of the bicycle before the user leaves the bicycle, are prevented from initiating an alarm signal.

The first monostable 130 is provided with a resistor r1 and capacitor c1 the value of which determines the length of the time delay.

A second monostable 132, likewise implemented by the 4538B device, is provided with a resistor r2 and a capacitor c2, the value of which determine a time constant for a rising edge of a pulse applied to the second monostable 132 by the motion sensor, indicated generally by reference numeral 134, as the ball 72 rolls over the contact array as described above. This time constant determines the time that the sensor contacts must be open before the voltage at the input of the monostable 132 rises to the trigger point of the monostable 132. The longer this time constant is, the less sensitive the device will be to short jolts and vibration and to rapid rotation of the motion sensor.

A resistor r3 and capacitor c3 connected to the second monostable 132 determine the time period of the alarm signal.

The output of the second monostable 132 is applied to the sense pin of integrated circuit device 134 (MC14467). The alarm is triggered when this output goes low, the integrated circuit device 134 driving the transducer 112 to provide the alarm and to indicate when the battery is low.

A light emitting diode d1 provides a load for battery testing and gives a visible indication that the alarm is armed.

Resistor r4 and capacitor c4 determine the cycle time of the alarm.

Switch contact s1, connected through diode d1 to the integrated circuit device 134, is activated by the pin 100 to provide a warning of tampering of the device as described above.

I claim:

1. An anti-theft device for attachment to an object, comprising;

alarm generator means for emitting an audible alarm in response to an alarm signal;

motion sensor means for initiating said alarm signal in response to movement of said anti-theft device;

retaining means for engaging said object to secure said anti-theft device to said object;

means responsive to tampering with said retaining means for initiating a tamper signal;

said alarm generator means including means generating an alarm in response to said tamper signal;

battery means for providing electrical power to said anti-theft device: and battery securing means releasably engageable by said retaining means for securing said battery means within said anti-theft device in a storage position in which said battery means are inaccessible from the exterior of said anti-theft device;

said battery securing means being releasable, by disengagement of said retaining means from said battery securing means, to permit removal of said battery means from said anti-theft device.

2. An anti-theft device as claimed in claim 1, wherein said retaining means comprise a retaining member which is displaceable, relative to the remainder of said anti-theft device, into and from an operative position in which said retaining member is in engagement with said object for securing said anti-theft device to said object, said tampering responsive means comprising actuator means responsive to displacement of said retaining member from said operative position for initiating said tamper signal.

3. An anti-theft device as claimed in claim 2, wherein said retaining member is rotatable relative to the remainder of said anti-theft device and said actuator means are operable in response to the rotation of said retaining member.

4. An anti-theft device as claimed in claim 3, wherein said retaining member comprises a threaded shaft, said anti-theft device including means for receiving said threaded shaft in said operative position and a securing member in threaded engagement with said shaft for releasably securing said shaft in said operative position, said actuating means comprising means responsive to relative unthreading motion of said shaft and said securing member for initiating said tamper signal.

5. An anti-theft device as claimed in claim 3, wherein said shaft is formed with a flat surface, said activating means comprising an actuating pin seated at one end thereof on said flat surface so as to be longitudinally displaceable in response to rotation of said shaft and electrical contact means for producing the tamper signal in response to actuation of said contact means by the longitudinal displacement of said actuating pin.

6. An anti-theft device as claimed in claim 1, wherein said alarm generator means comprise time delay means for preventing the initiation of the alarm signal for a predetermined time period following initiation of operability of said anti-theft device by a user.

7. An anti-theft device as claimed in claim 1, wherein said alarm generator means comprise electro-acoustic transducer means for emitting audible alarm sound waves and a conical member co-axial with said electro-acoustic transducer means for deflecting said sound waves from said anti-theft device.

8. An anti-theft device as claimed in claim 7, wherein said electro-acoustic transducer means has a cavity forming a Helmholz resonator.

9. An anti-theft device for attachment to an object, comprising;

alarm generator means for emitting an audible alarm in response to an alarm signal;

motion sensor means for initiating said alarm signal in response to movement of said anti-theft device;

a housing containing said alarm generator means and said motion sensor means;

retaining means for engaging said object to secure said housing to said object; and means responsive to tampering with said retaining means for initiating a tamper signal;

said alarm generator means including means generating an alarm in response to said tamper signal; and said retaining means comprising an elongate retaining member engageable in an operative position thereof with said object for securing said anti-theft device to said object; means in threaded engagement with said retaining member for retaining said retainer member in said operative position, actuator means displaceable in the transverse direction of said retaining member for initiating said tamper signal and deflector means on said retaining member intermediate the ends thereof for effecting such transverse displacement of said actuator means upon rotation of said retaining member.

10. An anti-theft device as claimed in claim 9, wherein said deflector means comprise a recess in said retaining member, said recess having a flat surface engaged by said actuator means for displacing the latter on rotation of said retaining member.

11. An anti-theft device as claimed in claim 9, further comprising a pair of lateral projections at opposite sides of said housing and spaced from said housing to receive parts of said object between said projections and said housing sides, and means defining openings in said projections and said housing sides for receiving said retaining member in said operative position in retaining engagement with said object parts.

12. An anti-theft device as claimed in claim 9, further comprising battery means for providing electrical power to said anti-theft device, and battery securing means releasably engageable by said retaining means for securing said battery means within said anti-theft device in a storage position in which said battery means are inaccessible from the exterior of said anti-theft device, said battery securing means being releasable, by disengagement of said retaining means from said battery securing means, to permit removal of said battery means from said anti-theft device.

* * * * *